US006719373B2

(12) United States Patent
Zimmermann

(10) Patent No.: US 6,719,373 B2
(45) Date of Patent: Apr. 13, 2004

(54) CHAIR WITH A HEADREST

(75) Inventor: Jürgen Zimmermann, Happurg (DE)

(73) Assignee: Dauphin Entwicklungs-u. Beteiligungs-GmbH, Hersbruck (DE)

( * ) Notice: Subject to any disclaimer, the term of this patent is extended or adjusted under 35 U.S.C. 154(b) by 0 days.

(21) Appl. No.: 10/281,989

(22) Filed: Oct. 29, 2002

(65) Prior Publication Data

US 2003/0111890 A1 Jun. 19, 2003

(30) Foreign Application Priority Data

Dec. 14, 2001 (DE) ..... 101 61 587

(51) Int. Cl.[7] ..... A47C 1/10
(52) U.S. Cl. ..... 297/410; 297/408; 297/391
(58) Field of Search ..... 297/408, 410, 297/391, 353, 344.18, 344.12

(56) References Cited

U.S. PATENT DOCUMENTS

| | | | | | |
|---|---|---|---|---|---|
| 2,897,878 | A | | 8/1959 | Mungovan | |
| 3,837,705 | A | * | 9/1974 | Marraccini | 297/353 |
| 3,865,450 | A | | 2/1975 | Bruenig | |
| 4,923,250 | A | * | 5/1990 | Hattori | 297/410 |
| 5,213,395 | A | | 5/1993 | Korteweg et al. | |
| 5,992,937 | A | * | 11/1999 | Pilhall | 297/408 |
| 6,045,181 | A | * | 4/2000 | Ikeda et al. | 297/216.12 |
| 6,074,010 | A | * | 6/2000 | Takeda | 297/391 |
| 6,074,011 | A | * | 6/2000 | Ptak et al. | 297/408 |
| 6,088,640 | A | * | 7/2000 | Breed | 701/45 |
| 6,193,314 | B1 | * | 2/2001 | Chiang | 297/301.7 |
| 6,199,947 | B1 | * | 3/2001 | Wiklund | 297/216.12 |
| 6,368,261 | B1 | * | 4/2002 | Doehler | 482/142 |
| 6,471,296 | B2 | * | 10/2002 | Lance | 297/410 |
| 6,499,805 | B1 | * | 12/2002 | Watadani | 297/408 |
| 6,508,512 | B2 | * | 1/2003 | Saberan et al. | 297/408 |
| 6,565,155 | B1 | * | 5/2003 | Huang | 297/353 |
| 2002/0038969 | A1 | * | 4/2002 | Whitmore et al. | 297/391 |
| 2002/0113483 | A1 | * | 8/2002 | Fischer et al. | 297/408 |

FOREIGN PATENT DOCUMENTS

| | | |
|---|---|---|
| DE | 24 19 483 | 11/1975 |
| DE | 100 48 779 | 4/2002 |
| FR | 1 417 128 | 10/1965 |
| FR | 2 765 841 A1 | 1/1999 |
| WO | WO 00-74531 A2 | 12/2000 |

* cited by examiner

*Primary Examiner*—Peter M. Cuomo
*Assistant Examiner*—Erika Garrett
(74) *Attorney, Agent, or Firm*—Browdy and Neimark

(57) ABSTRACT

A chair, in particular an office chair, comprises a pedestal; a seat support propped thereon; a seat supporting itself on the seat support; a backrest support mounted on the seat support; a headrest support mounted on the backrest support; and a headrest mounted on the headrest support and having a height setting mechanism for height adjustment of the headrest and an inclination setting mechanism for adjustment of an angle of inclination a of the headrest.

18 Claims, 5 Drawing Sheets

CHAIR WITH A HEADREST

BACKGROUND OF THE INVENTION

1. Field of the Invention

The invention relates to a chair, in particular an office chair.

2. Background Art

Chairs with headrests have been familiar for a long time. As a rule the headrests have the drawback of complicated height adjustment by locking mechanisms. Adjustment of inclination is not possible as a rule.

SUMMARY OF THE INVENTION

It is an object of the invention to embody a chair with a headrest, the height and angle of inclination of which are as easy as possible to regulate. The gist of the invention resides in that a headrest is simultaneously provided with a height adjustment device and a device for inclination adjustment.

According to the invention, this object is attained in a chair, in particular an office chair, which comprises a pedestal; a seat support propped thereon; a seat supporting itself on the seat support; a backrest support for a backrest, the backrest support being mounted on the seat support; a headrest support mounted on the backrest support; and a headrest mounted on the headrest support and having a height setting mechanism for height adjustment of the headrest, and an inclination setting mechanism for adjustment of the angle of inclination a of the headrest.

Additional features and details of the invention will become apparent from the ensuing description of an exemplary embodiment, taken in conjunction with the drawing.

DESCRIPTION OF THE PREFERRED EMBODIMENT

Figure 1:
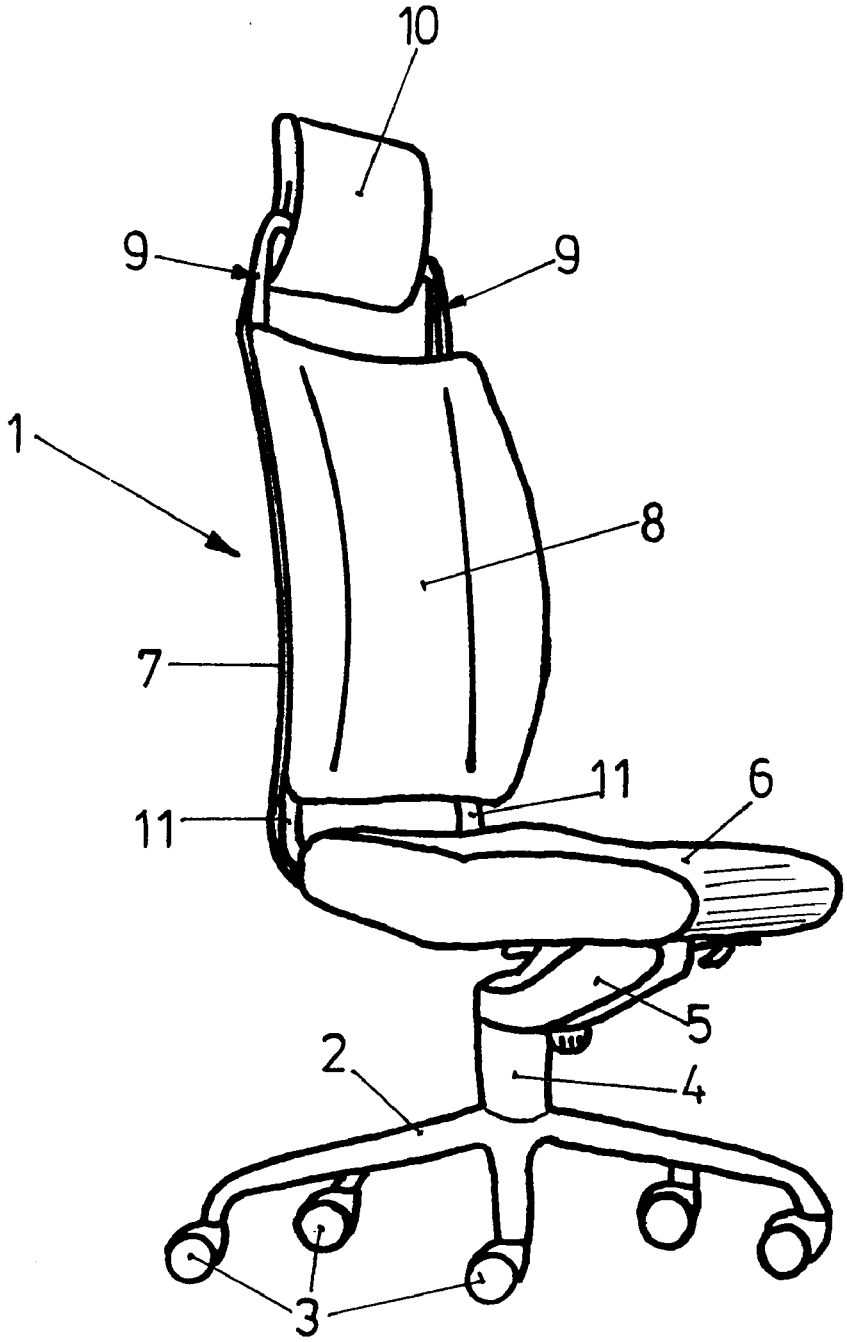
FIG. 1 is an illustration of an office chair with a headrest.

A chair 1 seen in FIG. 1, in particular an office chair, comprises a pedestal 2, which supports itself on the ground by way of casters 3. Mounted on the pedestal 2 is an adjustable-height chair column 4, to the upper end of which a seat support 5 is detachably fixed, with an upholstered seat 6 mounted thereon. Attached to the rear end of the seat support 5 is a substantially upward backrest support 7, with an upholstered backrest 8 fixed thereto. Attached to the upper end of the backrest support 7 is a headrest support 9 with a headrest 10 fixed thereto.

The following is a detailed description of the structure of the headrest 10, taken in conjunction with FIGS. 2 to 5. The backrest support 7 comprises two substantially vertical and parallel bars 11 which run as far as to the upper end of the backrest 8, passing by their upper end into a headrest support bracket 12. The brackets 12 continuously pass by their upper end into a horizontal shaft-press-fit bearing 13 that tapers cross-sectionally. The free ends 14 of the bearings are turned towards each other. The headrest 10 is supported vis-à-vis the brackets 12 and joined thereto.

Figure 5:
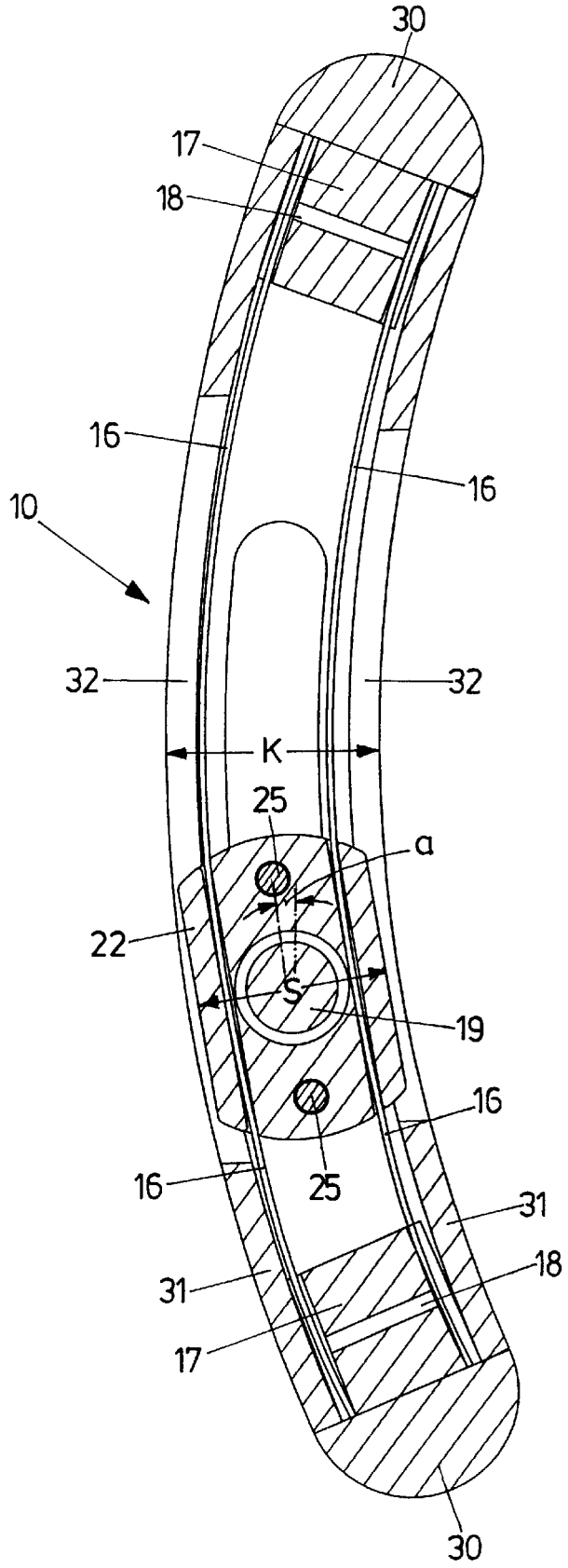
FIG. 5 is a section on the line V—V of FIG. 2.

The headrest 10 has a frame 15 formed by two parallel pairs of rails 16 and two interconnecting cross bars 17. As seen in FIG. 5, the rails 16 are curved and consist for instance of spring steel sheet. The rails 16 of a pair of rails run in parallel one on top of the other. The cross bars 17 have the shape of an elongated cuboid, its ends standing out beyond the fastening points 18 that connect the cross bars 17 with the rails 16. A shaft 19 passes between the two pairs of rails 16, at both ends having journals 20 which are fixed by press-fit in corresponding recesses 21 of the bearing 13. As a result, the shaft 19 is fixed substantially non-rotatably relative to the bearings 13. The frame 15 is joined to the shaft 19 by way of two pairs of friction guide shoes 22. Centrally the shoes 22 have a hole 23 that the shaft 19 passes through. On sides turned towards each other, the shoes 22 each have two grooves 24, the depth of which is slightly smaller than half the width of the rails 16. Two shoes 22 at a time are united to form a pair 26 by two screws 25. The four grooves 24 of a pair 26 enclose the two rails 26, forming two ducts. The friction between the shoes and the rails 16 is adjustable by the screws 25. The pairs 26 are displaceable on the rails 16 against a counterforce, constituting a height setting mechanism for the headrest 10. The friction between the rails 16 and the two pairs 26 is regulated such that, in any pre-determined position, the headrest 10 is stationary towards the externally supported shaft 19 without any force acting from outside.

In the vicinity of the hole 23, the inner fronts 27 of the shoes 22 have a conical widening 28 of the hole 23. As a result, an annular chamber with a rubber ring 29 placed therein originates between the shaft 19 on the one hand and the two shoes 22 of a pair 26 on the other hand. The conical surfaces of the chamber in the vicinity of the widening 28 help press the rubber ring 29 against the shaft 19 when two shoes 22 are screwed together, whereby pre-determined friction is adjustable between the shaft 19 and the frame 15. Since the shaft 19 is fixed non-rotatably relative to the bearing 13, the headrest 10 can only be pivoted about the shaft 19 against the action of force. Without any force acting from outside, the headrest 10 will stay in any preset inclination at an angle of inclination a relative to the vertical. In this regard, the shaft 19 combines with the shoes 22, constituting an inclination setting mechanism for adjustment the angle of inclination a of the headrest 10.

Figure 2:
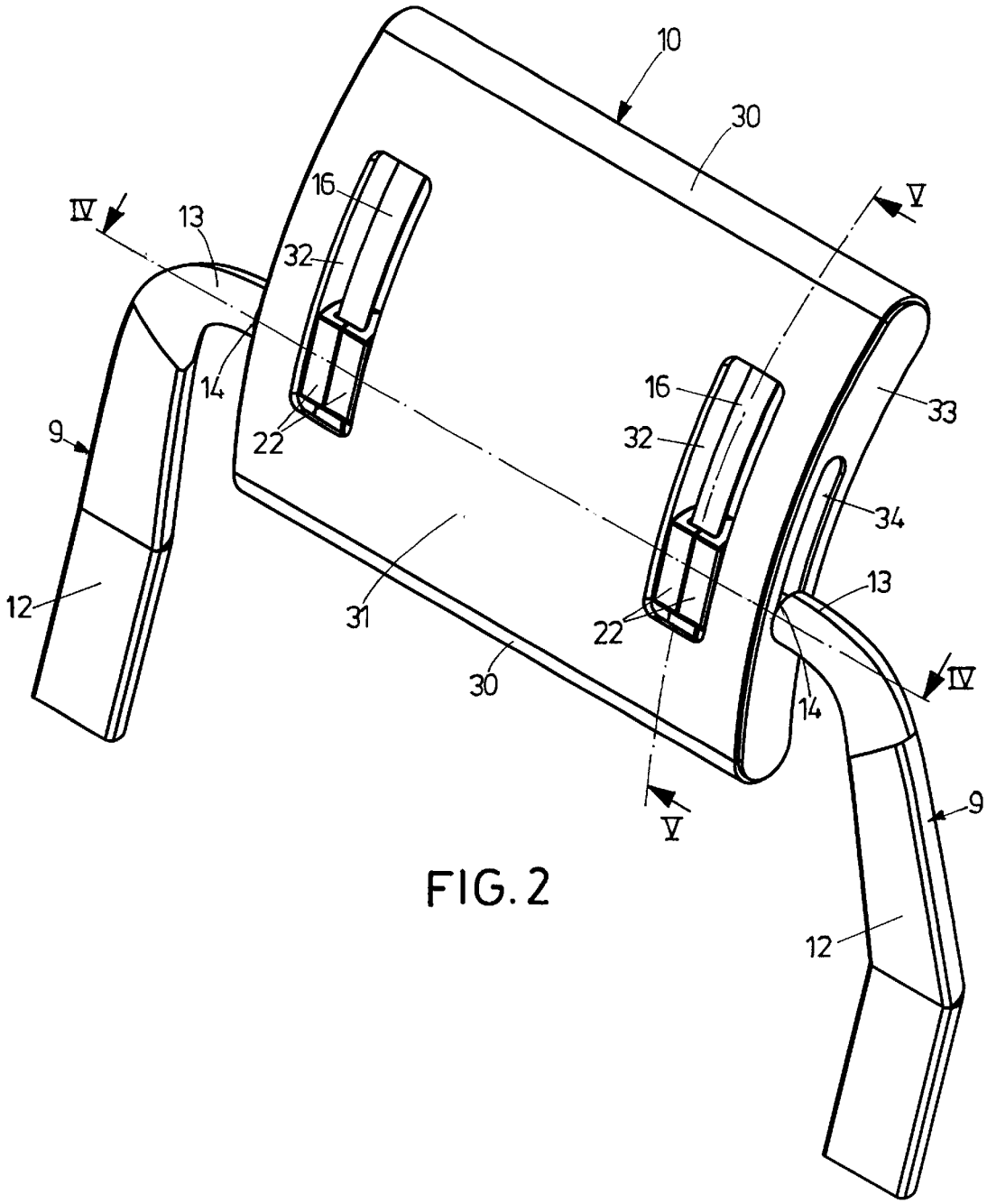
FIG. 2 is a detail, on an enlarged scale, of the headrest of FIG. 1.
Figure 3:
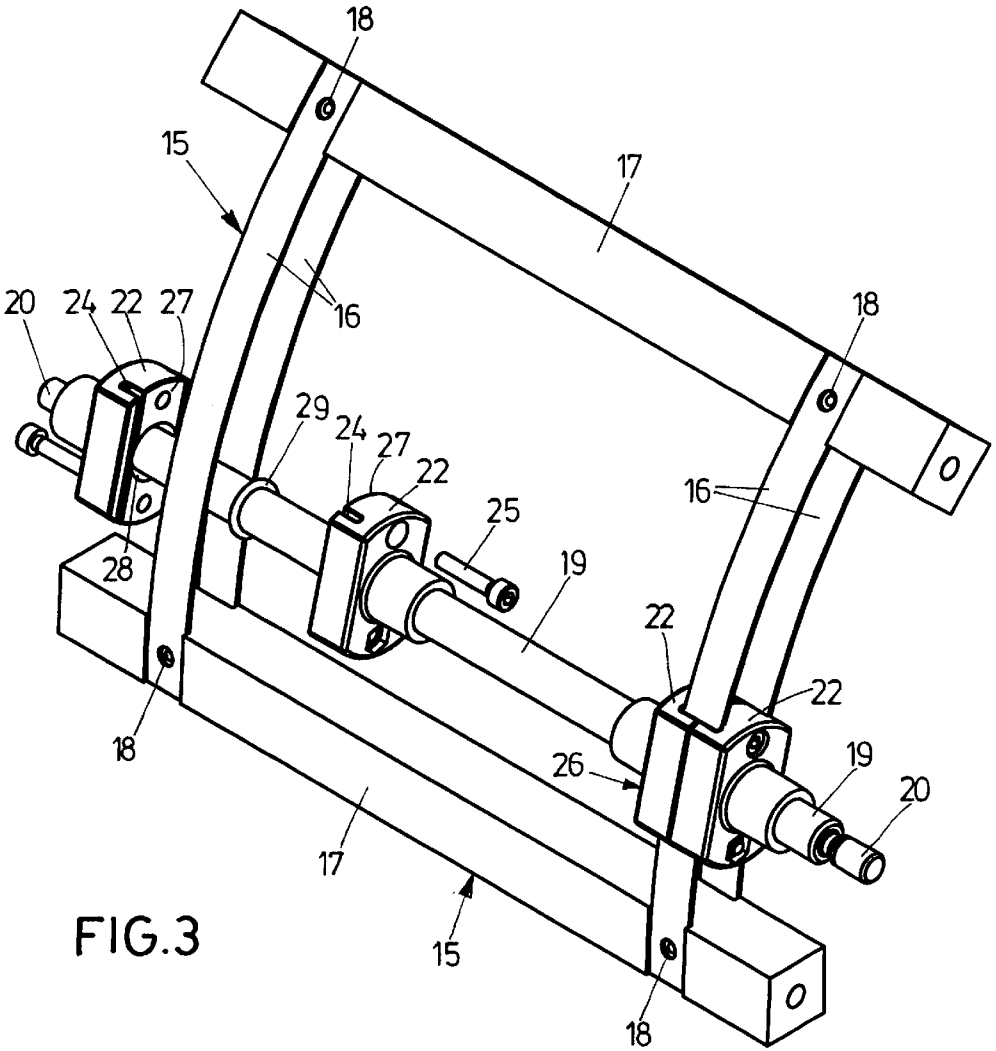
FIG. 3 is an illustration of a framework construction of the headrest of FIG. 2.
Figure 4:
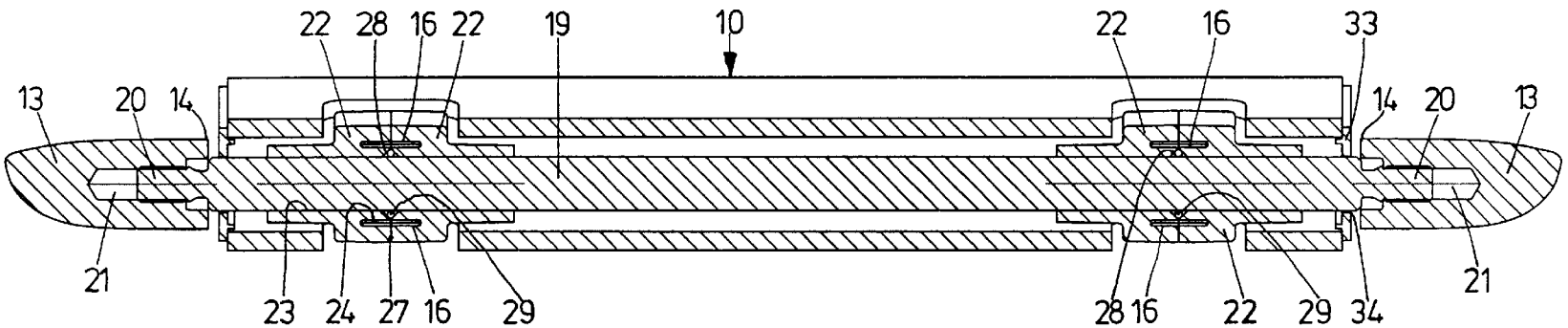
FIG. 4 is a section on the line IV—IV of FIG. 2.

The frame 15 is covered with a multi-piece facing for instance of wood. Two semi-cylindrical sections 30 are mounted on the top side of the upper cross bar 17 and on the bottom side of the lower cross bar 17. A curved cover plate 31 is fixed to the front and rear. The cover plates 31 have rectangular recesses 32 along the range the shoes 22 travel through upon height adjustment; parts of the shoes project into these recesses 32. This enables as compact as possible a design of the headrest 10 to be put into practice, because the total thickness K of the facing of the headrest 10 only slightly exceeds the thickness S of the shoes 22. Two curved frontal plates 33 with two curved oblong holes 34 are mounted on the fronts of the frame 15, the shaft 19 being displaced in the oblong hole 34. The headrest 10, which is illustrated in FIG. 2 only with its facing, is finished for example with leather or fabric as seen in FIG. 1.

The following is a detailed description of the mode of operation of the headrest. For the height of the headrest 10 to be changed, the user of the chair 1 presses from above or from below. If the force is sufficient to overcome a given friction, the rails 16 are displaced in the grooves 24 of the shoes, as a result of which the height of the headrest 10 changes. Due to the friction acting between the rails 16 and the shoes 22, the headrest 10 is stable in the newly adjusted position and does not slide downwards again. If the angle of inclination a of the headrest is to be set, the user pivots the headrest about the shaft 19. Since the journals 20 are non-rotatably secured in the bearing 13, the shoes 22 are pivoted relative to the shaft 19. Due to the friction between the wall of the hole 23 and the shaft 19 and due to the friction, set by the rubber ring 29, between the shoes 22 and the shaft 19, a minimum turning moment is required for the headrest 10 to be pivoted about the shaft 19. When it is exceeded, pivoting of the headrest 10 takes place. If no external torque is exerted on the headrest 10, the headrest remains stationary in the position set.

Being curved backwards, the headrest 10 adapts to the contour of the back of the head and the neck of someone leaning backwards. Special advantages reside in that the angle of inclination a of the backrest 10 can adjust automatically when someone leans backwards. Adjustability in height of the headrest ensures that the upper part of a user's neck rests approximately level with the shaft 19 and that the pivotability of the headrest 10 corresponds substantially to that of the human neck. As a result, the headrest 10 conveys a feeling of ease and convenience. Special advantages reside in that the height of the headrest 10 and the angle of inclination can be set simultaneously and infinitely variably. Moreover, a headrest 10 that is rotatable by more than 360° offers the possibility for the user to employ it as a convex or concave headrest surface. In the position of the headrest 10 seen in FIGS. 1 and 2, the headrest surface is concave seen from the direction of the head. Upon rotation by 180° about the shaft 19, the opposite headrest surface may be used.

What is claimed is:

1. A chair, in particular an office chair, comprising a pedestal (2);

a seat support (5) propped thereon;

a seat (6) supporting itself on the seat support (5);

a backrest support (7) for a backrest (8), the backrest support (7) being mounted on the seat support (5);

a headrest support (9) mounted on the backrest support (7); and a headrest (10) mounted on the headrest support (9), the headrest (10) having a height setting mechanism for height adjustment of the headrest (10), wherein the height setting mechanism comprises at least one rail (16) fixedly connected with the headrest (10), wherein at least one friction guide shoe (22) is frictionally displaceably guided on the at least one rail (16) for changing the height of the headrest (10) and an inclination setting mechanism for adjustment of an angle of inclination a of the headrest (10), wherein the inclination setting mechanism comprises a shaft (19) that is supported in relation to the headrest support (9), wherein the at least one friction guide shoe (22) is lodged frictionally rotatably in relation to the shaft (19) for pivoting the headrest (10).

2. A chair according to claim 1, wherein the at least one rail (16) is curved relative to a vertical plane.

3. A chair according to claim 1, wherein two pairs of rails (16) are provided.

4. A chair according to claim 3, wherein the two pairs of rails (16) are united to form a frame by two cross bars (17).

5. A chair according to claim 4, wherein the frame (15) comprises a facing for definition of the outer contour of the headrest (10).

6. A chair according to claim 5, wherein the facing has a cover.

7. A chair according to claim 5, wherein the facing comprises two cover plates (31) which are fixed to the front and the rear of the frame (15).

8. A chair according to claim 7, wherein the cover plates (31) have recesses (32) along the range a friction guide shoe (22) travels through upon height adjustment.

9. A chair according to claim 5, wherein the facing comprises two frontal plates (33) which are mounted on the fronts of the frame (15).

10. A chair according to claim 9, wherein the two frontal plates (33) have two oblong holes (34) for displacing the shaft (19).

11. A chair according to claim 4, wherein the frame (15) is joined to the shaft (19) by way of two pairs of friction guide shoes (22).

12. A chair according to claim 11, wherein two friction guide shoes (22) are united to form a pair (26) by screws (25), the pair (26) enclosing a pair of rails (16).

13. A chair according to claim 12, wherein friction between the friction guide shoes (22) and rails (16) is adjustable by the screws (25).

14. A chair according to claim 12, wherein each friction guide shoe (22) has a hole (23) that the shaft (19) passes through.

15. A chair according to claim 14, wherein inner fronts (27) of the friction guide shoes (22) have a widening (28) of the hole (23), whereby a chamber between the shaft (19) and the two friction guide shoes (22) of a pair (26) is originated to place a rubber ring (29) therein.

16. A chair according to claim 15, wherein the rubber ring (29) is pressed against the shaft (19) when two friction guide shoes (22) are screwed together by the screws (25).

17. A chair according to claim 16, wherein friction is adjustable between the shaft (19) and the frame (15) by the screws (25).

18. A chair according to claim 1, wherein the shaft (19) is non-rotatably fixed relative to the headrest support (9).

* * * * *